US007413037B2

(12) United States Patent
Lin et al.

(10) Patent No.: US 7,413,037 B2
(45) Date of Patent: Aug. 19, 2008

(54) METAL FACE SEAL FOR AN EARTH-BORING BIT

(75) Inventors: Chih Lin, Spring, TX (US); Don Quy Nguyen, Houston, TX (US); Gregory L. Ricks, Spring, TX (US); Terry J. Koltermann, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 251 days.

(21) Appl. No.: 11/226,948

(22) Filed: Sep. 15, 2005

(65) Prior Publication Data

US 2006/0060359 A1 Mar. 23, 2006

Related U.S. Application Data

(60) Provisional application No. 60/610,849, filed on Sep. 17, 2004.

(51) Int. Cl.
*E21B 10/22* (2006.01)
*E21B 10/25* (2006.01)
*F16J 15/22* (2006.01)

(52) U.S. Cl. ..... 175/371; 175/372; 277/379; 277/380; 277/396

(58) Field of Classification Search ..... 175/371, 175/57, 327, 331, 372; 277/92, 336, 382, 277/390, 396, 379, 380, 385, 589, 586
See application file for complete search history.

(56) References Cited

U.S. PATENT DOCUMENTS 3,279,834 A * 10/1966 Budzynski ..... 403/51
3,940,155 A * 2/1976 Baumle ..... 277/558
4,666,001 A 5/1987 Burr
4,719,971 A * 1/1988 Owens ..... 166/191
4,747,604 A * 5/1988 Nakamura ..... 277/382
4,753,303 A 6/1988 Burr
4,753,304 A * 6/1988 Kelly, Jr. ..... 175/371
5,360,076 A 11/1994 Kelly, Jr. et al.
5,642,890 A * 7/1997 Zutz ..... 277/380
5,791,421 A 8/1998 Lin
5,873,576 A * 2/1999 Dietle et al. ..... 277/559
6,105,968 A * 8/2000 Yeh et al. ..... 277/399
6,123,338 A * 9/2000 Edelmann et al. ..... 277/551
6,142,249 A * 11/2000 Zahradnik et al. ..... 175/371
6,684,966 B2 2/2004 Lin et al.
7,066,287 B2 * 6/2006 Lin ..... 175/371
7,306,061 B2 * 12/2007 Lin et al. ..... 175/371

(Continued)

*Primary Examiner*—Jennifer H Gay
*Assistant Examiner*—John M Deboer
(74) *Attorney, Agent, or Firm*—Bracewell & Giuliani LLP

(57) ABSTRACT

A metal face seal for an earth boring drill bit where the drill bit has a bit body, at least one bit leg, a bearing pin on each bit leg, and a cone rotatably mounted on each bearing pin. The metal face seal is located in the cavity formed between the interior surface of the cone and the bearing pin. The metal face seal consists of a rigid seal ring having a forward surface that engages a rotating seal surface of the cone. An energizer ring biases the rigid seal ring toward the rotating seal surface. A secondary seal engages the bearing pin surface, the energizer ring, and the rigid seal ring. The secondary seal ring has a protuberance on its forward side for filling void spaces between the energizer ring, the rigid seal ring, and the secondary seal ring.

9 Claims, 3 Drawing Sheets

U.S. PATENT DOCUMENTS

| | | | | |
|---|---|---|---|---|
| 7,341,258 | B2 * | 3/2008 | Holt et al. | 277/584 |
| 2002/0135137 | A1 * | 9/2002 | Hammi | 277/637 |
| 2003/0075363 | A1 * | 4/2003 | Lin et al. | 175/372 |
| 2004/0031624 | A1 * | 2/2004 | Scott et al. | 175/371 |
| 2004/0238226 | A1 | 12/2004 | Lin | |
| 2005/0178589 | A1 | 8/2005 | Lin et al. | |

* cited by examiner

METAL FACE SEAL FOR AN EARTH-BORING BIT

CROSS-REFERENCE TO RELATED APPLICATION

This application claims priority to provisional patent application 60/610,849 filed Sep. 17, 2004.

FIELD OF THE INVENTION

This invention relates in general to earth-boring drill bits, and in particular to a bit that has a metal face bearing seal.

BACKGROUND OF THE INVENTION

A typical roller cone earth boring bit, such as used to drill wells, has three cones that roll around a common axis. The cones are mounted to bearing pins that depend from head sections. A seal contains lubricant within the cavity of the cone surrounding the bearing pin. A compensator in communication with the lubricant equalizes the pressure of the lubricant with the drilling fluid hydrostatic pressure on the exterior of bit. The purpose of the seal is to prevent the entry of foreign debris from the exterior of the bit that can enter and damage the earth boring bit. The head sections are welded together to form a body that is threaded at the upper end for connection to a drill string.

One type of seal is disclosed in U.S. Pat. No. 6,142,249, to Zahradnik, for a rigid metal face bearing seal with a secondary seal to partially seal against debris from the exterior of the bit. Despite the improvements achieved with the secondary seal, a void is formed between the metal face seal rigid ring, the energizing elastomer ring, and the secondary seal. This void then has to be filled with an oil or lubricant.

SUMMARY OF THE INVENTION

Briefly, the present invention is for an earth boring drill bit, which has a bit body with at least one bit leg, where the bit leg has a bearing pin. A cone is rotatably mounted over the bearing pin, and the cone has a rearward facing seal surface that rotates with the cone. This rearward facing seal surface may be an end of an insert ring mounted inside of the cone. There is also a rigid seal ring that has a forward facing seal surface which engages the rearward facing surface of the cone in sliding engagement to form a seal as the cone rotates during drilling.

An elastomeric energizer ring is squeezed between an outer diameter portion of the bearing pin and the rigid seal ring. This placement causes the energizer ring to bias the rigid seal ring forward into contact with the rearward facing seal surface.

An elastomeric secondary seal ring has a rearward side in contact with a portion of the bit leg. It also has a forward side that has both an outer and inner portion. The outer portion of a forward side of the secondary seal ring is in contact with rearward end of the rigid seal ring. The inner portion of the forward side of the secondary seal ring is in contact with the energizer ring. Between the outer and inner portions of the secondary seal ring, there is a forward extending protrusion. This protrusion, which may be generally triangular in shape, fills substantially all of the void formed between the rigid seal ring, the elastomeric energizer ring, and the secondary seal ring.

In the embodiment shown, the secondary seal ring according to the present invention has an inner portion of the forward side that has an undeformed radius that is substantially equal to an undeformed radius of the rearward side of the elastomeric energizer ring. The rearward facing seal surface of the cone has an inner and outer diameter. The forward facing seal surface of the rigid seal ring also has an inner and outer diameter. The inner and outer diameters of the rearward facing surface of the cone may be substantially equal to the inner and outer diameters of the forward facing seal surface of the rigid seal ring.

Additionally, the portion of the bit leg engaged by a rearward side of the bearing pin may have a recess in the bit leg having a flat base bounded by radiused inner and outer ends. This allows the rearward side of the secondary seal ring, containing when undeformed a rearward extending rounded rib, to deform flat against the flat base when the secondary seal ring is installed.

In the embodiment shown, the portion of the bearing leg engaged by the elastomeric secondary seal ring may have a recess having an outer end formed at a radius that is between one-third and one-half of a nominal undeformed axial thickness of the elastomeric secondary seal ring.

In the preferred embodiment, the rigid seal ring has both an outer surface and an inner surface. The outer surface may have both a rearward portion and a forward portion where the rearward portion has a smaller outer diameter than the forward portion. The bearing pin may have a ridge that engages the rearward side of the energizer ring and the forward end of the elastomeric secondary seal ring adjacent to the concave section of the secondary seal ring. The secondary seal ring while undeformed may have a chamfered edge at the corner between the forward side and the outer portion of the elastomeric secondary seal ring.

DETAILED DESCRIPTION OF THE INVENTION

Figure 1:
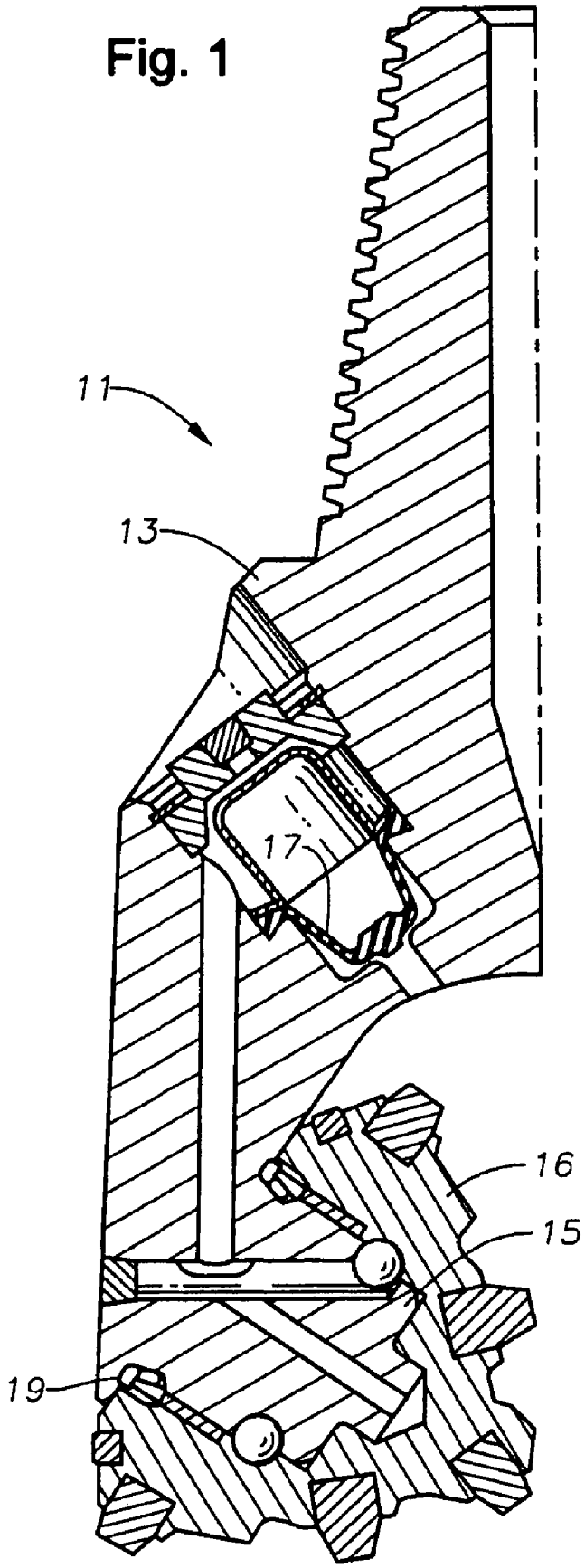
FIG. 1 is a sectional view of an earth-boring bit having a seal constructed in accordance with this invention.

Referring to FIG. 1, an earth-boring drill bit or drill bit 11 has a bit body with at least one bit leg 13, and typically three legs. Each bit leg 13 has a depending bearing pin 15. A cone 16 rotatably mounts over each bearing pin 15. A metal face seal 19 seals lubricant within the cavity of cone 16 surrounding bearing pin 15. A compensator 17 is in communication with the lubricant for equalizing the pressure of the lubricant with the drilling fluid hydrostatic pressure on the exterior of bit 11.

Figure 2:
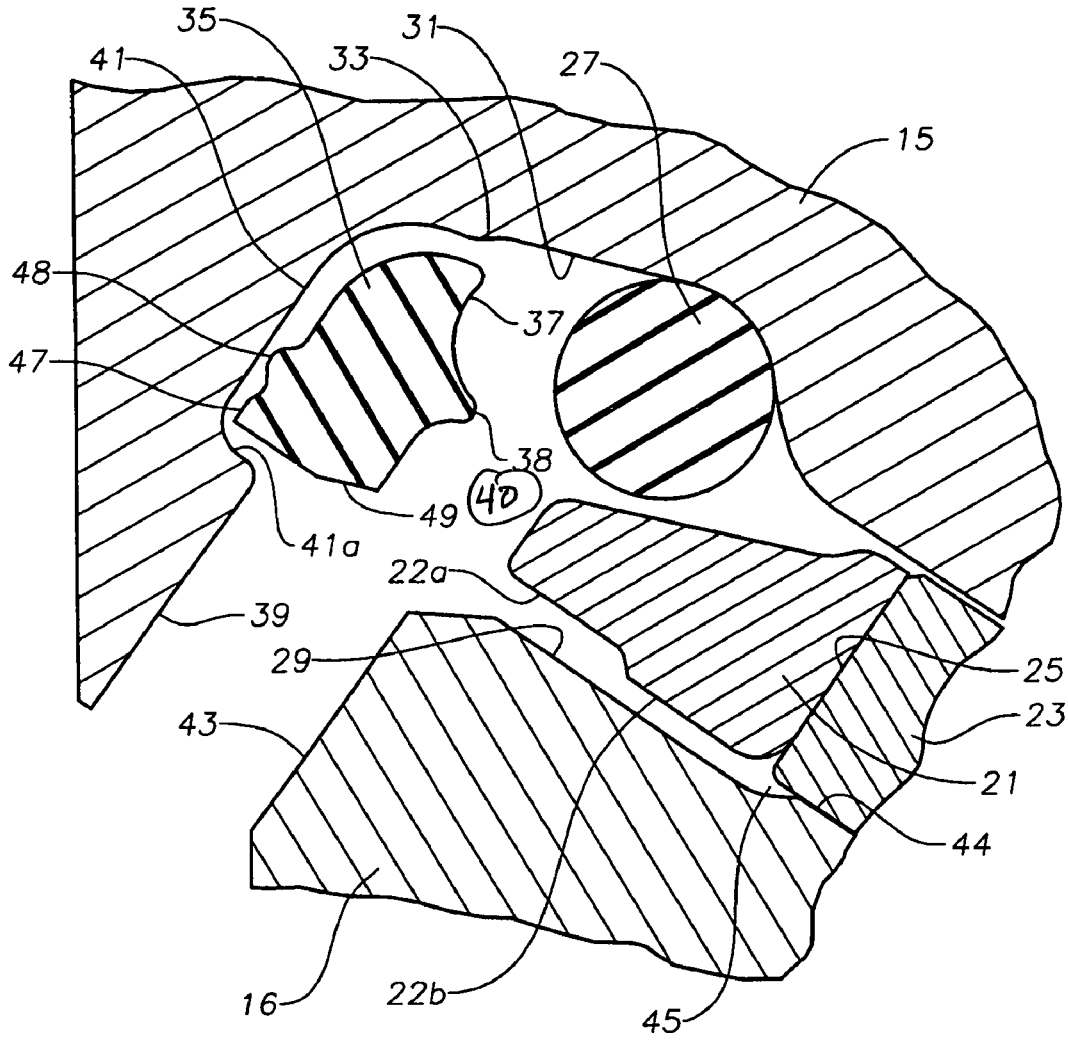
FIG. 2 is an enlarged sectional view of the metal face seal in FIG. 1, shown unassembled in the bit.
Figure 3:
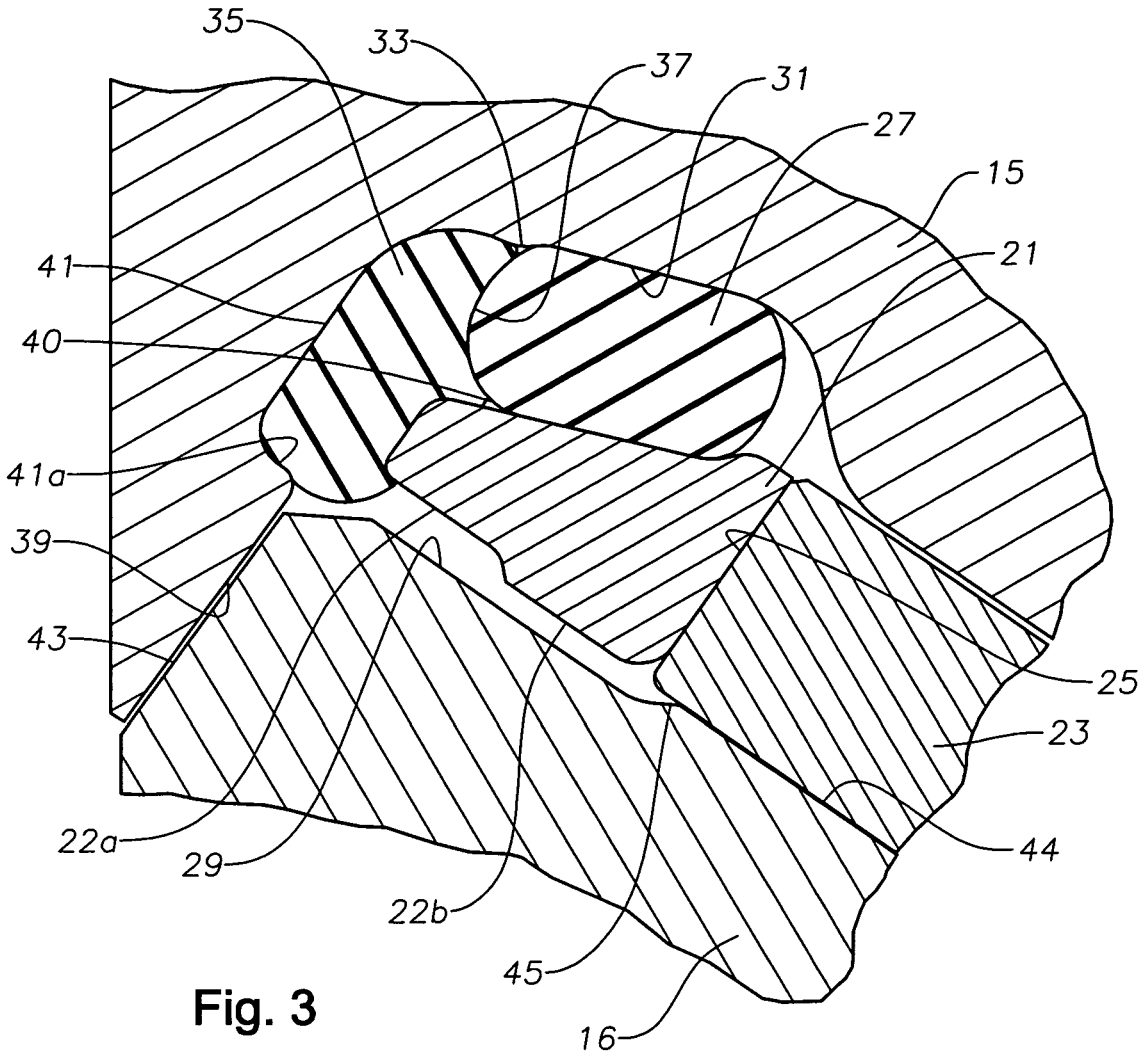
FIG. 3 is an enlarged sectional view of the metal face seal in FIG. 1, shown assembled in the bit.

Referring to FIG. 2 and FIG. 3, a forward end of rigid seal ring 21 engages a rearward end of insert or insert ring 23 to form a seal surface 25. Insert 23 is a cylindrical member secured within the cavity of cone 16 for rotation therewith. The rigid seal ring 21 includes an exterior surface with a rearward portion 22*a* and a forward portion 22*b*. Rearward portion 22*a* has a smaller outer diameter than forward portion 22*b*. A chamfer or shoulder is located at the intersection of the rearward portion 22*a* and the forward portion 22*b*. A radial distance from cone cavity 29 to the rearward portion 22*a* is approximately twice the distance from cone cavity 29 to forward portion 22*b*. The radial thickness of the rigid seal ring 21 at seal surface 25 is approximately the same as insert 23. The net result of thickening the base of the rigid seal ring 21 is to allow for a larger area of seal surface 25 over the prior art.

An elastomeric energizer ring 27, which may be an o-ring or other cross-sectional shaped ring, sits between the interior surface of the rigid seal ring 21 and gland surface 31 of bearing pin 15. Gland surface 31 in conjunction with the surface of cone cavity 29 defines a bearing seal gland between bearing pin 15 and cone 16. Gland surface 31 has a rounded protrusion or ridge 33 that engages the rearward portion of the elastomeric energizer ring 27 to reduce axial movement of the elastomeric energizer ring 27. Rounded protrusion 33 has the additional advantage of eliminating the need for sandblasting gland surface 31.

A secondary seal ring 35 contacts rounded protrusions 33. A concave portion 37 of the secondary seal ring 35 contacts the elastomeric energizer ring 27. The concave portion 37 has a rounded triangular shaped protrusion 38 (FIG. 2) on its forward side that engages the elastomeric energizer ring 27 and the rigid seal ring 21. The rounded triangular shaped protrusion 38 is sized to fill substantially all of the triangular space 40 between the rigid seal ring 21, the secondary seal ring 35, and the elastomeric energizer ring 27. Reducing the volume of triangular space 40 eliminates the need for filler oil of the prior art because up to 95% of triangular space 40 is filled by the triangular protrusion 38 of the secondary seal ring 35.

A last machined surface 39 where the bit leg 13 engages the bearing pin 15 includes a machined groove 41, the depth of which is between one third to one half the nominal undeformed axial thickness T of the secondary seal ring 35, to accommodate the secondary seal ring 35 between the last machined surface 39 and the rigid seal ring 21. Machined groove 41 has an outer wall 41*a* that has a cylindrical portion intersecting the last machined surface 39. A line tangent to outer wall 41*a* at the intersection with the last machined surface 39 is substantially perpendicular to the last machined surface 39. The secondary seal ring 35 engages the outer wall 41*a* in a manner that less than substantial extrusion could incur in drilling service to cause damage to the secondary seal ring 35. Additionally, the last machined surface 39 includes an outer end formed at a radius that is between one-third and one-half of the nominal undeformed axial thickness T of the secondary seal ring 35.

The purpose of the secondary seal ring 35 is to seal against entry of foreign debris, particularly drilling mud particles from the exterior of the bit, that can enter the seal gland between the gap formed between the last machined surface 39 and back face 43 of cone 16.

Cone cavity 29 has a reduced diameter portion 44 onto which insert 23 is captured. A sloped transition 45 joins cone cavity 29 to the reduced diameter portion 44. Sloped transition 45 is located slightly forward of seal surface 25. The location of the sloped transition 45 allows for extended life of the drill bit by reducing the accumulation of particulate adjacent to seal surface 25.

Figure 4:
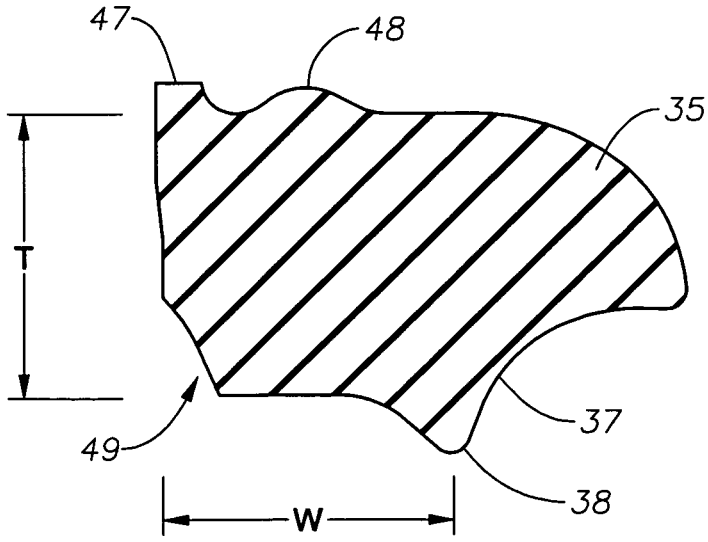
FIG. 4 is an enlarged cross-sectional view of the secondary seal ring of FIGS. 2 and 3 in a relaxed condition removed from the bit.

Referring to FIG. 4, FIG. 4 is an enlarged cross-sectional view of the secondary seal ring 35. Preferably, the secondary seal ring 35 is a continuous ring formed of nitrile elastomer material of about 40-45 durometer (Shore A) and a modulus of elasticity of about 100-600 psi, preferably between 200-350 psi. The unique shape of the secondary seal ring 35 maximizes the filled volume of the assembled drill bit and prevents the introduction of foreign debris into the seal gland.

The concave portion 37 of the secondary seal ring 35 allows for the secondary seal ring to better mate with the elastomeric energizer ring 27 in the assembled drill bit. This is achieved by the concave portion 37 of the secondary seal ring 35 having an undeformed interior radius similar to that of an undeformed exterior radius of the elastomeric energizer ring 27. This enlarged area of contact between the secondary seal ring 35 and the elastomeric energizer ring 27 work to minimize any volume formed between the secondary seal ring 35, the elastomeric energizer ring 27 and the rigid seal ring 21.

The secondary seal ring 35 also contains a raised edge 47 and a rounded rib 48 that have widths between 25% and 35% of the nominal undeformed axial thickness T of the secondary seal ring 35, and heights between 10% and 15% of the nominal undeformed axial thickness T of the secondary seal ring 35. The purpose of the raised edge 47 is to minimize the nip area and thereby defer the entry of a foreign fluid, particles and/or debris into the seal gland; the purpose of the rounded rib 48 is to form an area of consistent and continuous high-stress to deter the advance of foreign fluid, particles and/or debris into the seal gland when the secondary seal ring 35 is in place in an assembled unit.

The exterior face of the secondary seal ring 35 has a chamfered outer edge 49 to reduce stress concentration and potential extrusion on the secondary seal ring 35. Chamfering the outer edge 49 between 5 and 25 degrees has the advantage of increasing the life of the secondary seal ring 35 by removing sharp corners subject to damage from particulate entering the drill bit between the last machined surface 39 and the back face 43 of cone 16.

Axial thickness T of the secondary seal ring 35 is greater than the gap formed between the machined groove 41 and the end of the rigid seal ring 21. The intent is to provide a sufficient "squeezing" effect on the secondary seal ring 35 between the machined groove 41 and the rigid seal ring 21. A net squeezing effect is approximately between 20% and 25% of the uncompressed or relaxed thickness T of the secondary seal ring 35 using nominal values with cone 16 forced outward on bearing pin 15. The radial dimension W in FIG. 4 should be substantially equal to the radial thickness of the rearward end of the rigid seal ring 21 to provide a sufficient surface area for effective sealing.

Having described the invention above, various modifications of the techniques, procedures, components and equipment will be apparent to those skilled in the art. It is intended that all such variations within the scope and spirit of the appended claims be embraced thereby.

The invention claimed is:

1. An earth boring drill bit comprising:

a bit body with one bit leg;

the bit leg having a bearing pin;

a cone rotatably mounted over the bearing pin;

the cone having a rearward facing seal surface that rotates with the cone;

a rigid seal ring having a forward facing seal surface that engages the rearward facing surface in sliding engagement to form a seal;

an elastomeric energizer ring squeezed between an outer diameter portion of the bearing pin and the rigid seal ring to bias the rigid seal ring forwardly;

an elastomeric secondary seal ring having a rearward side in contact with a portion of the bit leg, an outer portion of a forward side in contact with a rearward end of the rigid seal ring, and an inner portion of the forward side in contact with the elastomeric energizer ring;

a forward extending protrusion between the inner portion and the outer portion of the forward side of the elastomeric secondary seal ring, the forward extending protrusion filling substantially all of a void between the rigid seal ring and the elastomeric energizer ring; and wherein any remaining portions of the void are free of any filler oil.

2. The bit according to claim 1, wherein the forward extending protrusion on the elastomeric secondary seal ring is generally triangular.

3. The bit according to claim 1, wherein:

the portion of the bit leg engaged by a rearward side of the bearing pin comprises a recess in the bit leg having a flat base bounded by radiused inner and outer ends; and wherein the rearward side of the elastomeric secondary seal ring while undeformed has a rearward extending rounded rib that is deformed flat against the flat base when the elastomeric secondary seal ring is installed.

4. The bit according to claim 1, wherein the rigid seal ring further comprises:

an outer surface and an inner surface;

the outer surface having both a rearward cylindrical portion and a forward cylindrical portion, wherein the rearward cylindrical portion has a smaller outer diameter than the forward cylindrical portion.

5. The bit according to claim 1, wherein the secondary seal ring while undeformed has a chamfered edge at the corner between the forward side and an outer portion of the elastomeric secondary seal ring.

6. An earth boring drill bit comprising:

a bit body with one bit leg;

the bit leg having a bearing pin;

a cone rotatably mounted over the bearing pin;

the cone having a rearward facing seal surface that rotates with the cone;

the rearward facing seal surface of the cone comprises an end of an insert ring mounted in the cone;

a rigid seal ring having a forward facing seal surface that engages the rearward facing surface in sliding engagement to form a seal;

an elastomeric secondary seal ring having a rearward side in contact with a portion of the bit leg, an outer portion of a forward side in contact with a rearward end of the rigid seal ring, and an inner portion of the forward side in contact with the elastomeric energizer ring;

the secondary seal ring having in its undeformed state a rounded, generally triangular protusion on its forward end and when the secondary seal ring is installed on the bit, the protuberance wedges between a portion of the rigid seal ring and the energizer ring, filling substantially all of a void between therigid seal ring and the energizer ring, wherein the void is free of any filler oil; and the secondary seal ring having in its undeformed state a rearward extending rounded rib, and when the secondary seal ring is installed on the bit, the rib deforms flat against a flat base on the bit leg.

7. The bit according to claim 6, wherein the flat base on the bit leg comprises a recess in the bit leg, the recess being bounded by radiused inner and outer ends.

8. The bit according to claim 6, wherein the rigid seal ring further comprises:

an outer surface and an inner surface;

the outer surface having both a rearward cylindrical portion and a forward cylindrical portion, wherein the rearward cylindrical portion has a smaller outer diameter than the forward cylindrical portion.

9. An earth boring drill bit comprising:

a bit body with one bit leg;

the bit leg having a bearing pin;

a portion of the bit leg engaged by a rearward side of the bearing pin comprising a recess in the bit leg having a flat base bounded by radiused inner and outer ends;

a cone rotatably mounted over the bearing pin;

the cone having a rearward facing seal surface that rotates with the cone;

a rigid seal ring having a forward facing seal surface engaging the rearward facing surface in sliding engagement to form a seal;

an elastomeric energizer ring squeezed between an outer diameter portion of the bearing pin and the rigid seal ring to bias the rigid seal ring forwardly;

an elastomeric secondary seal ring having a rearward side in contact with the portion of the bit leg, an outer portion of a forward side in contact with a rearward end of the rigid seal ring, and an inner portion of the forward side in contact with the elastomeric energizer ring;

the rearward side of the elastomeric secondary seal ring while undeformed has a rearward extending rounded rib that is deformed flat against the flat base when the elastomeric secondary seal ring is installed;

a forward extending protrusion between the inner portion and the outer portion of the forward side of the elastomeric secondary seal ring, the forward extending protrusion filling substantially all of the void between the rigid seal ring and the elastomeric energizer ring; and wherein any remaining portion of the void is free of any filler oil.

* * * * *